US006428264B1

(12) United States Patent
Jensen et al.

(10) Patent No.: US 6,428,264 B1
(45) Date of Patent: Aug. 6, 2002

(54) SIDE DUMP BODY INCLUDING A MATERIAL COMPACTION ASSEMBLY

(75) Inventors: Layton W. Jensen, Thurston, NE (US); Ralph R. Rogers, Dakota Dunes, SD (US)

(73) Assignee: Thurston Mfg. Co., Thurston, NE (US)

( * ) Notice: Subject to any disclaimer, the term of this patent is extended or adjusted under 35 U.S.C. 154(b) by 0 days.

(21) Appl. No.: 09/549,473

(22) Filed: Apr. 14, 2000

(51) Int. Cl.[7] ..... B65F 3/16
(52) U.S. Cl. ..... 414/492
(58) Field of Search ..... 414/471, 501, 414/492, 719, 525.2, 525.6; 298/17.7, 17.8, 18

(56) References Cited

U.S. PATENT DOCUMENTS 4,005,789 A * 2/1977 Gladwyn et al. ..... 214/82 X
4,113,120 A * 9/1978 Pickrell ..... 214/38 X
5,501,567 A * 3/1996 Lanzdorf et al. ..... 414/408 X
5,560,289 A * 10/1996 Pernsteiner ..... 100/34 X

* cited by examiner

*Primary Examiner*—Christopher P. Ellis
*Assistant Examiner*—Kenneth W Bower
(74) *Attorney, Agent, or Firm*—Thomte, Mazour & Niebergall; Dennis L. Thomte

(57) ABSTRACT

A side dump body including a plurality of side dump body units pivotally mounted on a truck or trailer frame. Each of the side dump body units may be individually pivotally moved from a transport position to a dumping position wherein the contents of the dump body units may be dumped from the side of a truck or trailer. A material compactor is provided at the upper end of each of the body units for compacting material within the body unit. The material compactor may be moved from its operative compaction position wherein it overlies the upper end of the body unit to an inoperative position at one side of the body unit so that the body unit may be moved to its dumping position without interference from the material compactor.

11 Claims, 6 Drawing Sheets

SIDE DUMP BODY INCLUDING A MATERIAL COMPACTION ASSEMBLY

BACKGROUND OF THE INVENTION

1. Field of the Invention

This invention relates to a side dump body and more particularly to a side dump body for use on a trailer or truck. More specifically, the invention relates to a side dump body which has increased carrying capacity when compared to conventional side dump trailers and which has a material compaction assembly associated therewith. The material compaction assembly of this invention may also be used on walking floor bodies or live floor bodies.

2. Description of the Related Art

Dump bodies which are employed on trailers or trucks normally are of the end dump, live floor, walking floor, bottom dump type or the side dump type. Since the introduction of the side dump body disclosed in U.S. Pat. No. 5,480,214, side dump trucks and trailers have experienced wide acceptance. Perhaps the only drawback to the side dump body of U.S. Pat. No. 5,480,214 is that the body does not have as much carrying capacity as an end dump body due to the fact that the side walls of the side dump body extend upwardly and outwardly from a bottom wall, rather than extending vertically upwardly from a bottom wall as in most conventional end dump bodies.

Although the side dump bodies have met with considerable success, the side dump bodies of the prior art are not believed to have any capability of compacting the material within the body or container. If the material compaction assembly is associated with the side dump body, the side dump body has another use, that is, for the collection of refuse or the like.

SUMMARY OF THE INVENTION

A leak-proof side dump body is disclosed which has substantially vertically disposed side walls to increase the carrying capacity of the body as compared to those side dump bodies having upwardly and outwardly extending side walls. A plurality of horizontally spaced-apart supports are secured to the frame means of the truck or trailer. A side dump body is positioned between each pair of the supports and is pivotally secured thereto so that the dump body may be moved from a transport position to a dumping position.

A material compaction assembly is movably supported on the frame of the truck or trailer and is movable from a compaction position over the upper end of the dump body to an inoperative position at one side of the dump body. When the material compaction assembly is in its inoperative position, the side dump body may be pivotally moved to its dumping position without interference from the material compaction assembly. The material compaction assembly comprises a hood or housing having a support frame provided in the interior thereof. A flat material compaction member is movably supported on the support frame in the hood of the material compaction assembly and is movable from a position within the hood downwardly into the side dump body to compact the material therein.

The inoperative position of the material compaction assembly also provides a counterbalance during the dump cycle.

It is therefore a principal object of the invention to provide an improved side dump body for use on a truck or trailer which has a material compaction assembly mounted thereon.

Still another object of the invention is to provide a side dump body having an increased carrying capacity when compared to conventional side dump bodies and which has a material compaction assembly mounted thereon.

Still another object of the invention is to provide a material compaction assembly for a side dump body which may be moved from an operative position at the upper end of the body to an inoperative position adjacent the body so that the body may be pivotally moved to its dumping position without interference from the material compaction assembly.

Still another object of the invention is to provide a side dump trailer or truck wherein a plurality of side dump bodies having material compaction assemblies mounted thereon are individually selectively pivotally secured to the frame means of the truck or trailer.

Yet another object of the invention is to provide a material compaction assembly for a side dump body wherein the compaction assembly provides a counterbalance, when in its inoperative position, during the dump cycle.

Yet another object of the invention is to provide a material compaction assembly for a side dump body which secures the load during transport.

Yet another object of the invention is to provide a material compaction assembly for a side dump body which is leak-proof.

These and other objects will be apparent to those skilled in the art.

DESCRIPTION OF THE PREFERRED EMBODIMENT

Figure 1:
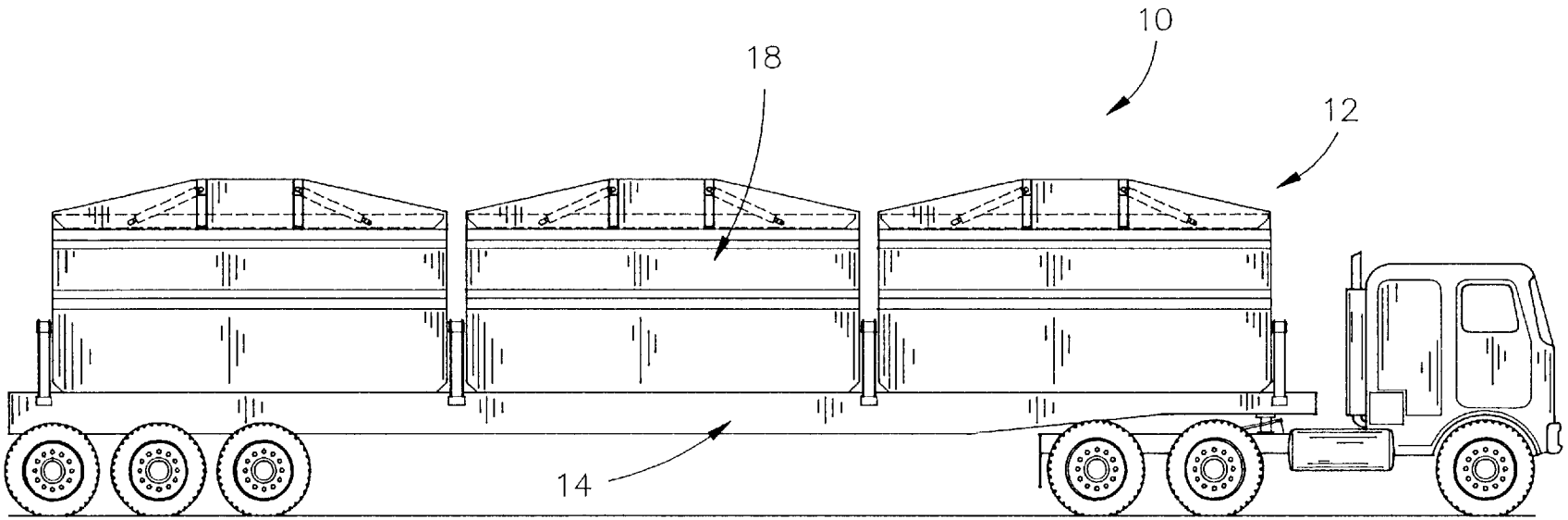
FIG. 1 is a side elevational view of the instant invention.

The side dump body apparatus of this invention is referred to generally by the reference numeral 10 and comprises one or more side dump units 12 mounted on a frame means 14 which may be incorporated into a trailer or into what is commonly called a straight truck. Although the drawings illustrate the side dump body 10 being mounted on a trailer, the side dump body could also be mounted on a truck as described.

Although the drawings illustrate a plurality of the side dump units 12 being mounted on a trailer, a single side dump unit 12 may be utilized if desired. Inasmuch as all of the side dump units 12 are identical, only a single side dump unit 12 will be described in detail.

Side dump unit 12 includes a body or tub 18 including a bottom wall 20, front wall 22, back wall 24 and opposite side walls 26 and 28. Front wall 22, back wall 24 and side walls 26 and 28 define an open upper end 30.

Supports 32 and 32' are secured to the frame means of the trailer in a spaced-apart relationship and are positioned rearwardly of the rear wall of the body 18 and are positioned forwardly of the front wall 22 of the body 18. Inasmuch as each of the supports 32 and 32' are identical, only support 32 will be described in detail. Support 32 is provided with upwardly extending projection 34 at one side thereof which is pivotally secured to the back or front wall by means of pin 36. Hydraulic cylinder 38 is pivotally connected at its base end to the support 32 at 39 and has its rod end pivotally connected to the back or front wall of the body 18 at 40. Thus, extension of the hydraulic cylinders 38 on the supports 32 will cause the body 18 to be pivotally moved from its transport position to its dumping position and vice versa.

The numeral 42 refers to a material compaction assembly which is operatively pivotally secured to the frame of the trailer and which may be positioned in its operative position, illustrated in FIG. 5, wherein it is positioned over the open upper end of the body 18 to an inoperative position at one side of the body 18 (FIG. 6), as will be described in more detail hereinafter.

Compaction assembly 42 includes a hood or housing 44 having a configuration such that it will close the upper end of the body 18 when it is in its operative or compaction position. A support framework 46 is provided in the interior of the hood 44.

Figure 4:
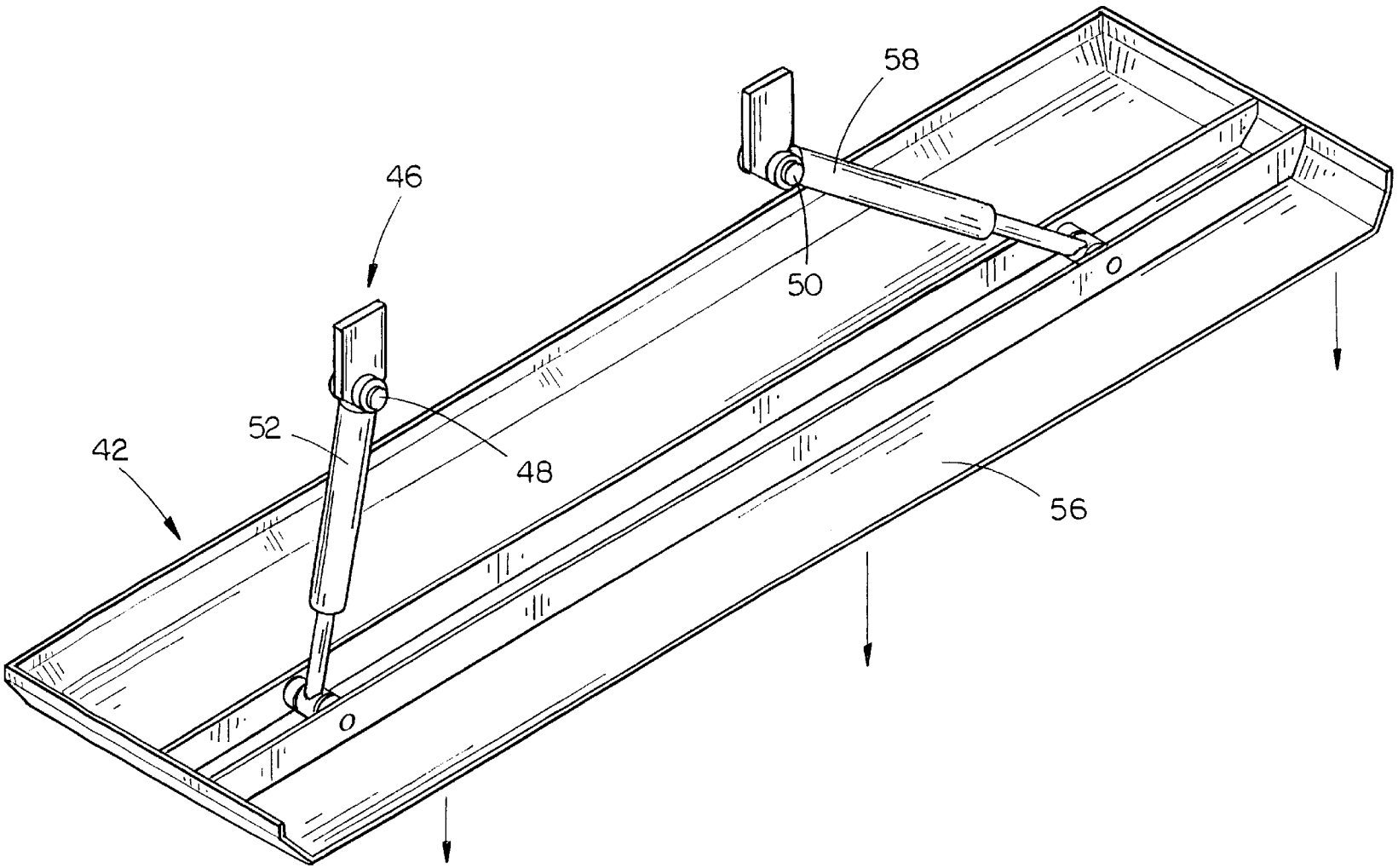
FIG. 4 is a perspective view illustrating a portion of the compaction assembly.

Framework 46 includes a pair of transversely extending frames, pipes or supports 48 and 50 which are positioned within the hood 14, as illustrated in FIG. 4.

A plurality of hydraulic cylinders 52 are pivotally connected at their base ends, in a horizontally spaced-apart relationship, to frame 48 and have their rod ends pivotally connected to a generally rectangular material compaction member 56. A plurality of hydraulic cylinders 58 have their base ends pivotally secured to frame 50 in a horizontally spaced-apart relationship and have their rod ends pivotally connected to the material compaction member 56 (FIG. 4). When the hydraulic cylinders 52 and 58 are in their retracted positions, the compaction member 56 is positioned within the interior of the hood or housing 44. When the cylinders 52 and 58 are extended, the compaction member 56 is lowered within the body 32 to compact the material therein.

Figure 5:
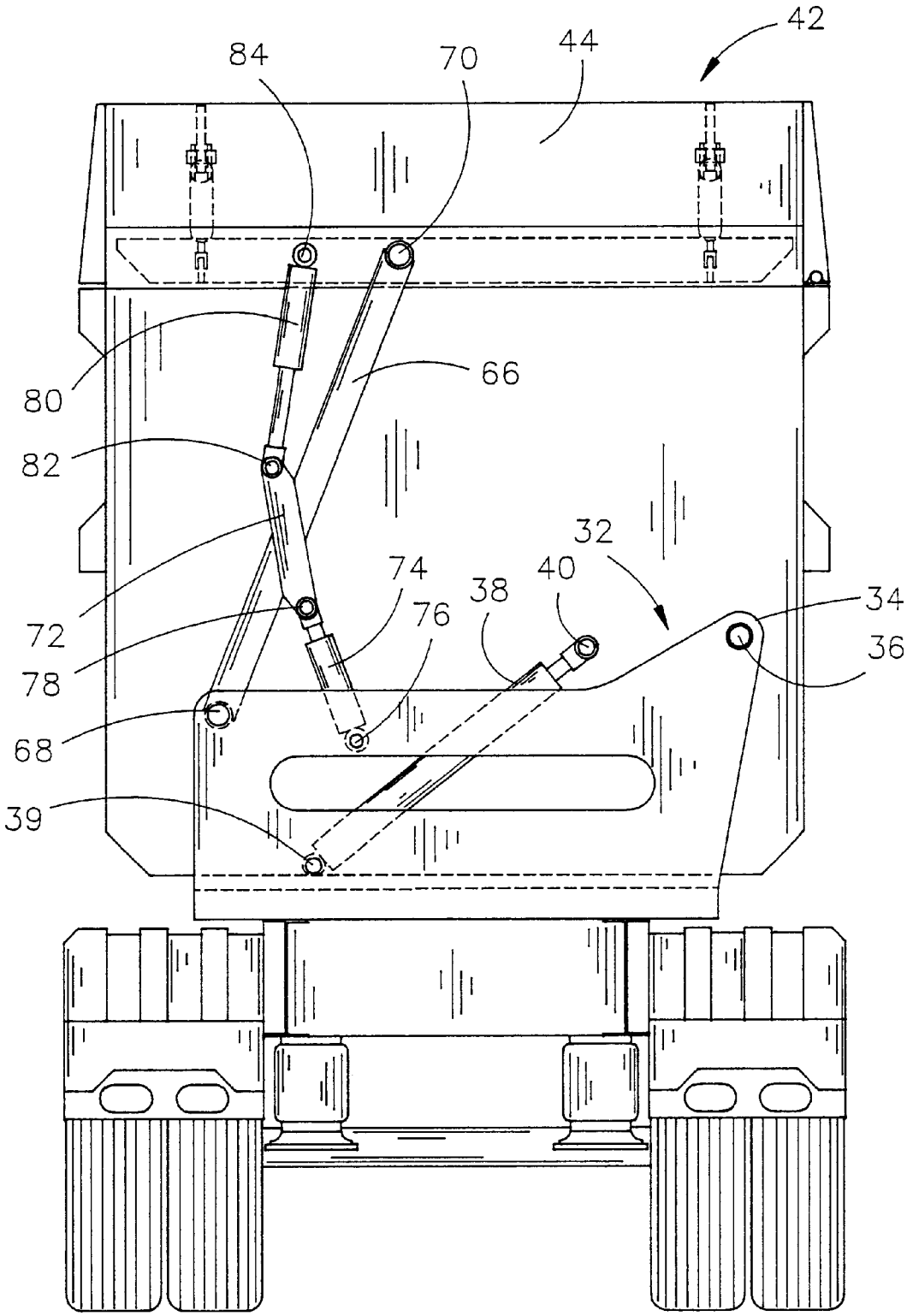
FIG. 5 is a rear elevational view of the invention.
Figure 6:
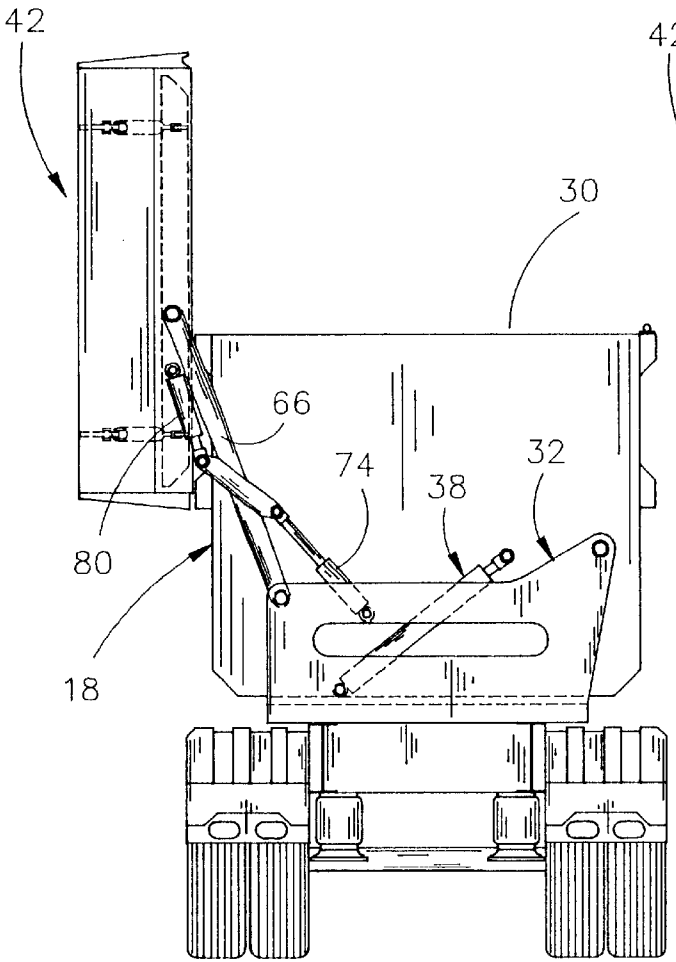
FIG. 6 is a rear elevational view of the invention illustrating the compaction assembly in its inoperative position.

Means is provided at each end of the body 18 for moving the compaction assembly between its operative position of FIG. 5 to the inoperative position of FIG. 6. Inasmuch as the pivoting means is identical, only the pivoting means at the rear of one of the bodies 18 will be described in detail. An elongated arm 66 has its lower end pivotally secured to the support 32 at 68 and has its upper end pivotally connected to one end of the material compaction assembly 42 at 70. Bar 72 is rigidly fixed to arm 66, as seen in the drawings. Hydraulic cylinder 74 has one end thereof pivotally connected to support 32 at 76 and has its other end pivotally connected to one end of the bar 72 at 78. Hydraulic cylinder 80 has its rod end pivotally connected to one end of the bar 72 at 82 and has its base end pivotally connected to one end of the material compaction assembly 42 at 84.

Figure 7:
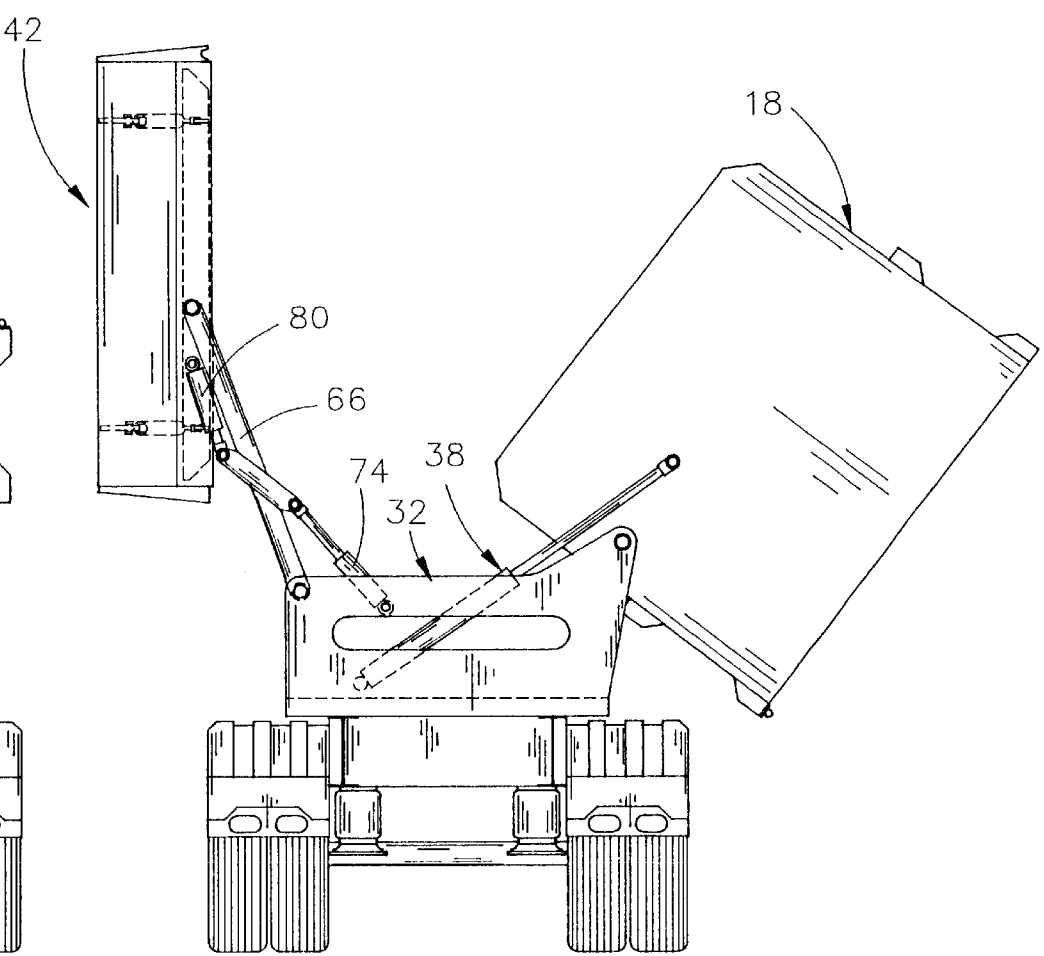
FIG. 7 is a view similar to FIG. 6 except that the side dump body has been pivotally moved to its dumping position.

Assuming that the material compaction assembly 42 is in its horizontally disposed position wherein it overlies the open upper end of the body 18 (FIG. 5), the material compaction assembly 42 is moved to its inoperative position (FIG. 6) as follows. Hydraulic cylinders 74 are initially extended somewhat which causes the arms 66 to pivotally move in a counterclockwise direction about pivot points 68 which causes the material compaction assembly 42 to be slightly raised upwardly from the upper end of the body 18. Once the material compaction assembly 42 has cleared the upper end of the body 18, the hydraulic cylinders 74 are extended and the hydraulic cylinders 80 are retracted which causes the material compaction assembly 42 to move to the substantially vertically disposed inoperative position at one side of the body 18. When the material compaction assembly 42 is in the inoperative position, the hydraulic cylinders 38 on the supports 32 and 32' may be extended so that the body 18 will be pivotally moved from its transport position to the dumping position, as illustrated in FIG. 7. When the material in the body 18 has been dumped laterally of the trailer, the hydraulic cylinders 38 are retracted to move the body 18 back to its transport position.

Figure 2:
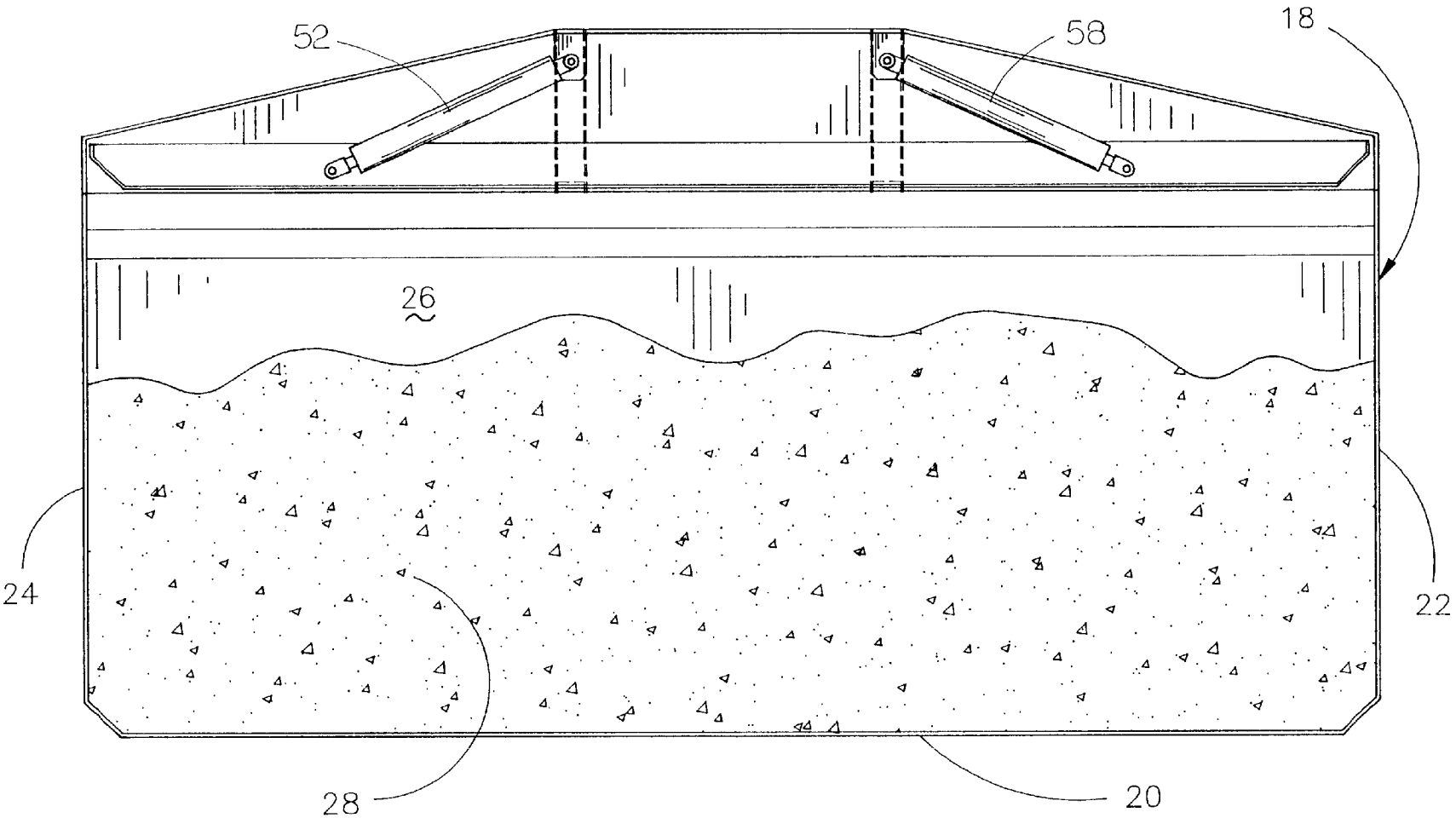
FIG. 2 is a side elevational view of one of the dump bodies with portions thereof cut away to more fully illustrate the invention.
Figure 3:
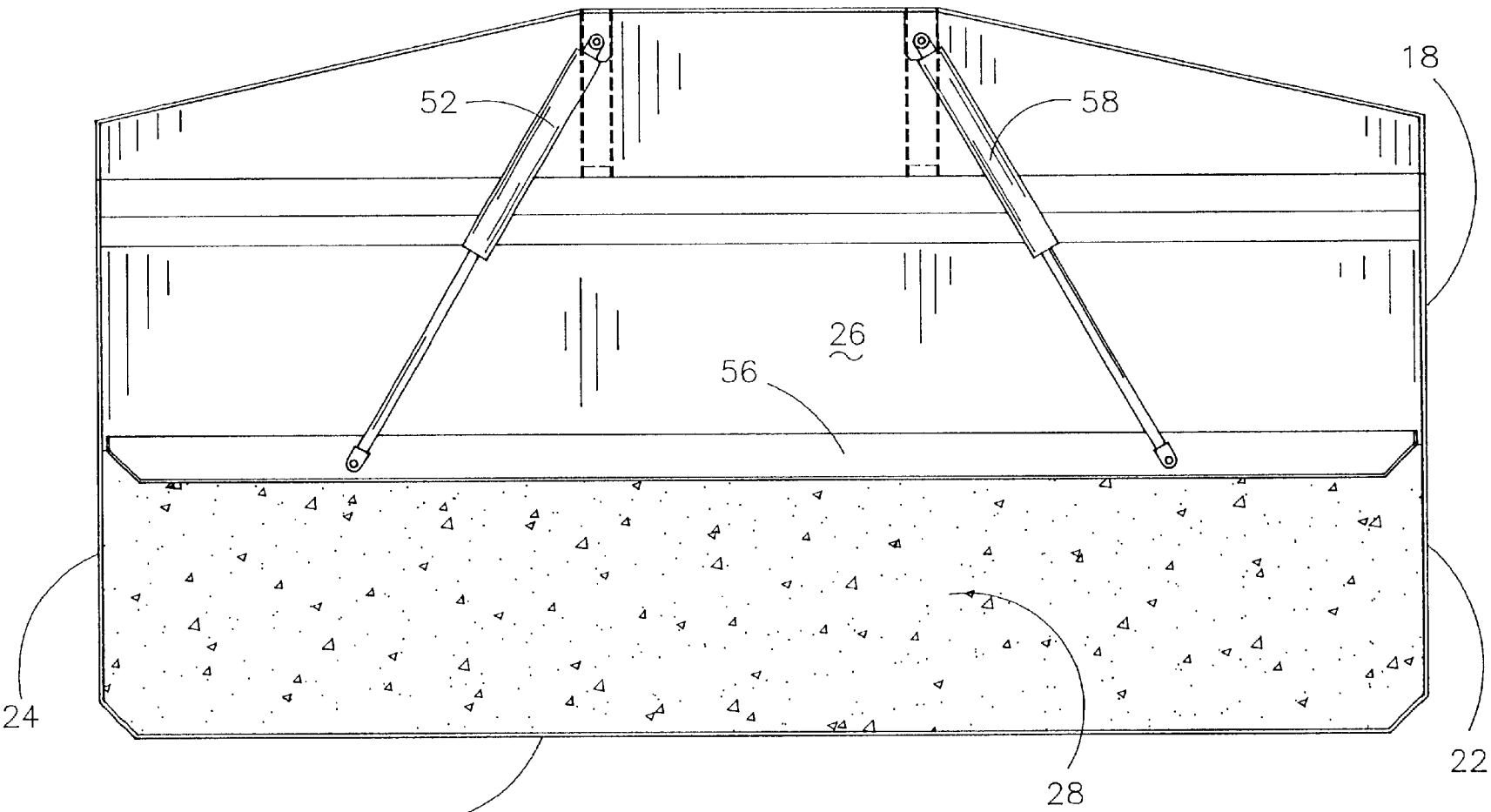
FIG. 3 is a view similar to FIG. 2 except that the compaction assembly has been moved downwardly within the body.

Simultaneously, hydraulic cylinders 74 are retracted and hydraulic cylinders 80 are extended to cause the material compaction assembly 42 to be pivotally moved from its vertically disposed inoperative position (FIG. 6) to its horizontally disposed operative or compaction position (FIG. 5). Assuming that the body has been filled with material which is to be compacted, the hydraulic cylinders 52 and 58 are extended to cause the compaction member 56 to move from a position within the hood 44 (FIG. 2) to the position illustrated in FIG. 3 to compact the material therein. The hydraulic cylinders 52 and 58 are then retracted to raise the compaction member 56 to the position illustrated in FIG. 2. Additional material is then inserted into the body 18 and the compaction process is repeated. The filling and compaction process is repeated until the body 18 is completely filled with compacted material.

Although the compaction assembly is ideally suited for use with a side dump body, it could also be used with a walking floor body or a live bottom body. It should be noted that the compaction assembly, when in its inoperative position, acts as a counterbalance during the dump cycle. Another advantage of this invention is that the compaction assembly secures the load in place during transport. Yet another advantage of this invention is that it is leak-proof.

Thus it can be seen that a novel side dump body having a material compaction assembly mounted thereon has been disclosed which accomplishes at least all of its stated objectives.

We claim:

1. In combination:

a wheeled frame means having a rearward end, a forward end, and first and second sides;

a side dump body movably positioned on said frame means and being pivotally movable from a transport position to a dumping position;

means for moving said dump body between its transport position and dumping position;

said dump body including a front wall, a back wall, a bottom wall, first and second side walls, and an open upper end;

a material compaction assembly selectively movably positioned on said dump body which extends over said open upper end and which includes a material compaction member which is movable from a retracted position at said open upper end of said dump body downwardly to a compaction position in the interior of said dump body to compact the material therein;

said material compaction assembly being movable from an operative position wherein it extends over said open upper end to an inoperative position to enable the pivotal movement of said dump body between its said transport and dumping positions without interference from said material compaction assembly;

said material compaction assembly comprising a housing having an open lower end and a support frame positioned within said housing; said material compaction member being positioned within said housing when in its said retracted position; connection means connecting said support frame and said material compaction member; and means for moving said material compaction member with respect to said support frame and said dump body;

said support frame comprising first and second frames and wherein means for moving said material compaction member comprises a first power cylinder means pivotally secured to and extending between said first frame and said material compaction member and a second power cylinder means pivotally secured to and extending between said second frame and said material compaction member.

2. The combination of claim 1 wherein a power cylinder means is provided in said material compaction assembly for moving said material compaction member between its said retracted and compaction positions.

3. The combination of claim 1 wherein said first power cylinder means comprises a pair of spaced-apart power cylinders and wherein said second power cylinder means comprises a pair of spaced-apart power cylinders.

4. The combination of claim 1 wherein a plurality of side dump bodies are movably positioned on said frame means and wherein at least some of said dump bodies have a material compaction assembly positioned thereon.

5. The combination of claim 1 wherein said front wall, said back wall, and said first and second side walls are substantially vertically disposed.

6. The combination of claim 1 wherein said material compaction assembly, when in its said inoperative position, acts as a counterbalance for said dump body as said dump body moves from its said transport position to its said dumping position.

7. The combination of claim 1 wherein said material compaction assembly is operatively pivotally mounted on said frame means.

8. The combination of claim 2 wherein said material compaction assembly is positioned at one side of said dump body when in its said inoperative position.

9. The combination of claim 8 wherein said material compaction assembly is substantially horizontally disposed when in its said operative position and is substantially vertically disposed when in its said inoperative position.

10. The combination of claim 9 wherein said dump body is pivotally moved towards said first side of said wheeled frame means when being moved to its said dumping position and wherein said material compaction assembly is moved towards said second side of said wheeled frame means when being moved from its said operative position to its said inoperative position.

11. The combination of claim 10 wherein said material compaction assembly is pivotally secured to said wheeled frame means and wherein a power cylinder means interconnects said material compaction assembly and said wheeled frame means for moving said material compaction assembly between its said operative and inoperative positions.

* * * * *